US006210185B1

(12) United States Patent
Sakurai et al.

(10) Patent No.: US 6,210,185 B1
(45) Date of Patent: Apr. 3, 2001

(54) CONNECTOR CONNECTING STRUCTURE

(75) Inventors: Kazuaki Sakurai; Yoshinori Uchida; Hirofumi Yamauchi; Yoko Nakamura; Atsushi Sasaki; Hiroyuki Kanbayashi, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/294,191

(22) Filed: Apr. 20, 1999

(30) Foreign Application Priority Data

Apr. 20, 1998 (JP) ..... 10-109865

(51) Int. Cl.[7] ..... H01R 13/62

(52) U.S. Cl. ..... 439/157; 439/347

(58) Field of Search ..... 439/157, 347

(56) References Cited

U.S. PATENT DOCUMENTS 6,083,017 * 7/2000 Matsumura ..... 439/157

FOREIGN PATENT DOCUMENTS

| | | | |
|---|---|---|---|
| 19727064A1 | 1/1998 | (DE) . | |
| 0363804A1 | 4/1990 | (EP) . | |
| 0825684A1 | 2/1998 | (EP) . | |
| 10-12320 | 1/1998 | (JP) ..... | H01R/13/629 |

OTHER PUBLICATIONS

German Office Action with English Translation.

* cited by examiner

*Primary Examiner*—Khiem Nguyen
*Assistant Examiner*—Michael C. Zarroli
(74) *Attorney, Agent, or Firm*—Sughrue, Mion, Zinn, Macpeak & Seas, PLLC

(57) ABSTRACT

A connector connecting structure in which the manipulation of an operating member for effecting a fitting operation and a disconnecting operation can be effected by one motion. A pair of moving members, which are movable in a direction perpendicular to a connector-inserting direction, is mounted on a female connector. An operating member, which can be displaced between a preset position and a set position in accordance with the movement of the moving members, is mounted on the female connector. Guide grooves are formed in the moving members, and cam pins are formed on a male connector. The guide grooves and cam pins jointly constitute a cam unit. During a connector-inserting process from an insertion start position to a provisionally-fitted position, the moving members are moved by the cam grooves and cam pins of the cam unit so as to displace the operating member from the set position to the preset position, and during the connector-inserting process from the provisionally-fitted position to a completely-fitted position, the operating member is turned from the preset position to the set position so as to move the moving members through the cam unit, thereby drawing the male connector into the completely-fitted position.

8 Claims, 16 Drawing Sheets

CONNECTOR CONNECTING STRUCTURE

BACKGROUND OF THE INVENTION

1. Field of the Invention

This invention relates to a connector connecting structure in which movable moving members are provided at one of male and female connectors, and an operating member, interlocked to the moving members, is provided at the one connector, and by operating this operating member, the two connectors can be fitted together with a small operating force.

2. Description of the Related Art

A connector connecting structure of the above type (see Japanese Patent Unexamined Publication No. Hei. 10-12320) which is shown in FIGS. 10 to 16(*b*) has been proposed. FIG. 10 is a perspective view showing male and female connectors separated from each other, FIG. 11 is a cross-sectional view showing the male and female connectors fitted together, and FIG. 12 is an exploded, perspective view of the male connector.

In FIGS. 10 to 12, the connector connecting structure comprises the male connector 1 and the female connector 2, and the male connector 1 can be inserted and fitted into the female connector 2. The male connector 1 has a hood portion 4 formed on an outer periphery of a male housing 3, and moving member chambers 5, as well as connector insertion chambers 6 communicating respectively with the moving member chambers 5, are formed respectively at upper and lower portions of the hood portion 4. Each of the moving member chambers 5 has an open end 7*a* (for inserting the moving member) at one side surface (end surface) of the male connector, and also has guide ports 7*b* at a connector-fitting side (front side) of the male connector. Each of the connector insertion chambers 6 has an insertion port 8 at the connector-fitting side.

A pair of moving members 9*a* and 9*b* are movably received in the upper and lower moving member chambers 5, respectively. Three cam grooves 10*a* are formed in the moving member 9*a* whereas three cam grooves 10*b* are formed in the moving member 9*b*. A central portion of the cam groove 10*a* or 10*b* is inclined relative to a connector-fitting direction, and the direction of inclination of the cam grooves 10*a* in the upper moving member 9*a* is opposite to the direction of inclination of the cam grooves 10*b* in the lower moving member 9*b*.

A pin portion 11 is formed at one end of each of the moving members 9*a* and 9*b*, and these pin portions 11 are rotatably supported respectively in slots 12*a* formed in an operating member 12. The pair of slots 12*a* are disposed at respective positions shifted relative to a direction perpendicular to the connector-inserting direction, and extend on a line interconnecting the pair of slots 12*a* and 12*a*. The operating member 12 has a rotation hole 12*b* disposed at a middle point of the line interconnecting the pair of slots 12*a*, and a pin portion 13*a* of an operating-member mounting portion 13 of the hood portion 4 is fitted in the rotation hole 12*b*. The operating member 12 is turned or pivotally moved between a preset position shown in FIG. 13(*a*), and a set position shown in FIG. 16(*a*), and the pair of moving members 9*a* and 9*b* are moved respectively in the opposite directions by this turning operation.

A number of press-connecting terminals (female terminals) 14 are fixedly mounted at a central portion of the male housing 3 of the male connector 1, and pin insertion holes (not designated by a reference numeral) are formed in the connector-fitting side or surface of the male housing 3, and are aligned respectively with the press-connecting terminals 14.

Three cam pins 16*a* are formed on an upper surface of an insertion portion 15*a* of a female housing 15 of the female connector 2 whereas three cam pins 16*b* are formed on a lower surface thereof. The upper cam pins 16*a* are arranged to correspond respectively to the cam grooves 10*a* in the moving member 9*a* whereas the lower cam pins 16*b* are arranged to correspond respectively to the cam grooves 10*b* in the moving member 9*b*. A number of pin terminals (male terminals) 17 are fixedly mounted at a central portion of the female housing 15, and one end portions of these pin terminals 17 project outwardly from a connector-fitting side of the female housing.

Next, the fitting operation of the above connector connecting structure will be described with reference to FIGS. 13(*a*) to 16(*b*). FIGS. 13(*a*), 14(*a*), 15(*a*) and 16(*a*) mainly show the position of the operating member 12, and FIGS. 13(*b*), 14(*b*), 15(*b*) and 16(*b*) are plan views corresponding respectively to the above figures, and show the relation between the cam grooves 10*a* and the cam pins 16*a* and the relation between the cam grooves 10*b* and the cam pins 16*b*.

As shown in FIG. 13(*a*), the operating member 12 is disposed in the preset position in which its distal end is spaced from the upper surface of the hood portion 4. In this condition, when the insertion portion 15*a* of the female housing 15 of the female connector 2 is inserted into the hood portion 4 of the male connector 1, the cam pins 16*a* are introduced respectively into the cam grooves 10*a* in the moving member 9*a* through the respective guide ports 7*b* in the hood portion 4 while the cam pins 16*b* are introduced respectively into the cam grooves 10*b* in the moving member 9*b* through the respective guide ports 7*b*. When the operating member 12 is turned from the position of FIGS. 13(*a*) and 13(b) toward the set position, the upper moving member 9*a* is moved right (as indicated by arrow R) while the lower moving member 9*b* is moved left (as indicated by arrow L). In accordance with these movements, the cam pins 16*a* and 16*b* on the female connector 2 move respectively along the cam grooves 10*a* and 10*b*, and simultaneously with this movement, the female connector 2 is drawn into the male connector 1.

When the operating member 12 is further turned from the position of FIGS. 14(*a*) and 14(*b*), each cam pin 16*a* or 16*b* on the female connector 2 passes through the inclined portion of the associated cam groove 10*a* or 10*b* as shown in FIGS. 15(*a*) and 15(*b*), so that the movement of the female connector 2 relative to the male connector 1 in the inserting direction is completed. The pin terminals 17 in the female connector 2 are inserted respectively in the press-connecting terminals 14 in the male connector 1, so that the two connectors 1 and 2 are electrically connected together.

When the operating member 12 is further turned from the position of FIGS. 15(*a*) and 15(*b*) into the set position as shown in FIGS. 16(*a*) and 16(*b*), each cam pin 16*a* or 16*b* reaches the inner end of the associated cam groove 10*a* or 10*b*, so that the fitting operation of the connector connecting structure is completed. A connector disconnecting operation can be effected by turning the operating member 12 in a direction opposite to the above-described direction.

In the conventional connector connecting structure, however, the fitting operation is started with the operating member 12 located in the preset position, and when this fitting operation s finished, the operating member 12 is located in the set position. Therefore, the rotational position of the operating member 12 at the time of starting the fitting operation is different from that at the time of finishing the fitting operation. Therefore, when the fitting operation is to be started with the operating member 12 kept in the set position, the operating member 12 must be once turned into the preset position before this fitting operation is effected. Thus, the fitting operation has been cumbersome. Generally, the place, at which the connector connecting structure is produced, is different from the place where the connector connecting structure is assembled, and therefore the connector connecting structure is transferred or conveyed with the operating member 12 kept in a compact condition, that is, in the set position, and this makes the fitting operation cumbersome. The same can be said with the disconnecting operation, and the operating member 12 need to be returned to the lever set position after the two connectors are disconnected from each other.

SUMMARY OF THE INVENTION

With the above problems in view, it is an object of this invention to provide a connector connecting structure in which the manipulation of an operating member for effecting a fitting operation and a disconnecting operation can be effected by one motion.

In order to achieve the above object, according to the invention, there is provided a connector connecting structure comprising: male and female connectors, the male connector being able to be inserted relative to the female connector from an insertion start position through a provisionally-fitted position into a completely-fitted position; a moving member which is movable in a direction different from a connector-inserting direction and mounted on one of the male and female connectors; an operating member which is displaced between a preset position and a set position in accordance with the movement of the moving member and mounted on the one connector; and cam means which is provided at the moving member and the other of the male and female connectors, wherein during a connector-inserting process from the insertion start position to the provisionally-fitted position, the cam means moves the moving member so as to displace the operating member from the set position to the preset position, and during the connector-inserting process from the provisionally-fitted position to the completely-fitted position, the operating member is manipulated to be moved from the preset position to the set position so as to move the moving member through the cam means, thereby displacing the other connector from the provisionally-fitted position to the completely-fitted position.

In this connector connecting structure, when the male connector is inserted relative to the female connector from the insertion start position to the provisionally-fitted position, with the operating member located in the set position, the moving member is moved by the cam means, and the movement of the moving member causes the operating member to be displaced into the preset position. Then, when the operating member is moved from the preset position to the set position, the moving member is moved by the cam means, thereby inserting the other connector into the completely-fitted position.

BRIEF DESCRIPTION OF THE DRAWINGS

FIG. 1(*b*) is a perspective view of a pair of moving members;

FIGS. 3(*b*) and 3(*c*) are illustrations showing a force acting between a cam groove and a cam pin;

DETAILED DESCRIPTION OF THE PREFERRED EMBODIMENT

One preferred embodiment of the present invention will now be described with reference to the drawings.

Figure 1A:
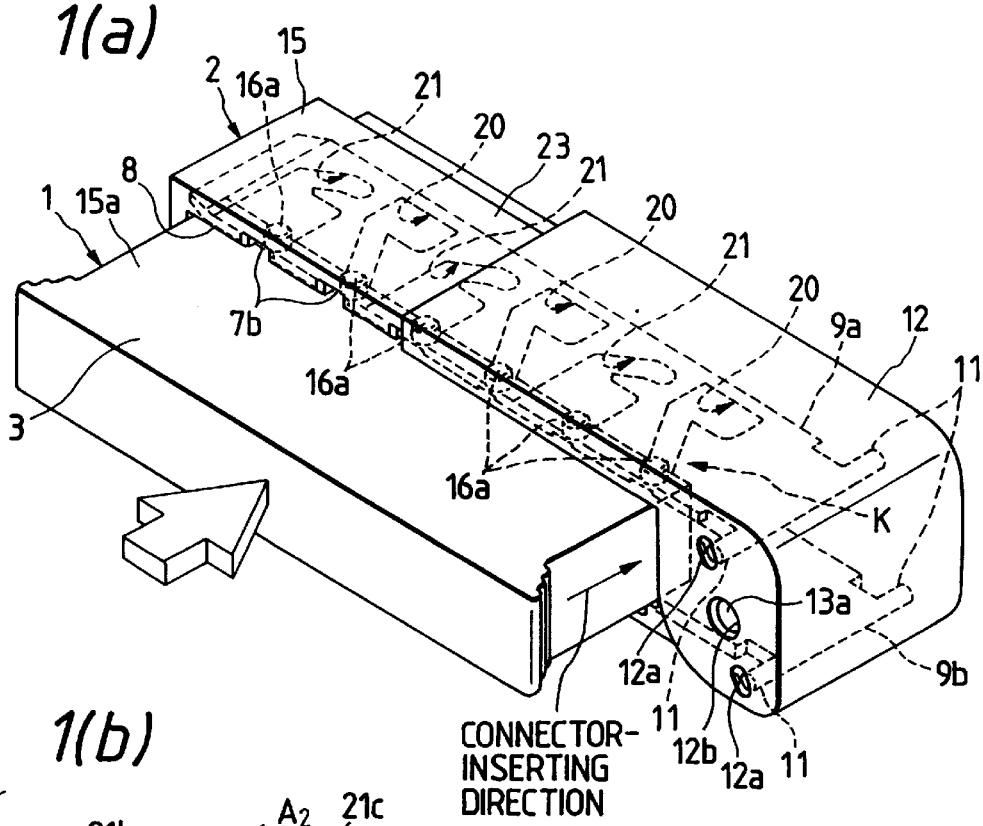
FIG. 1(*a*) is a perspective view of one preferred embodiment of a connector connecting structure of the present invention.
Figure 1B:
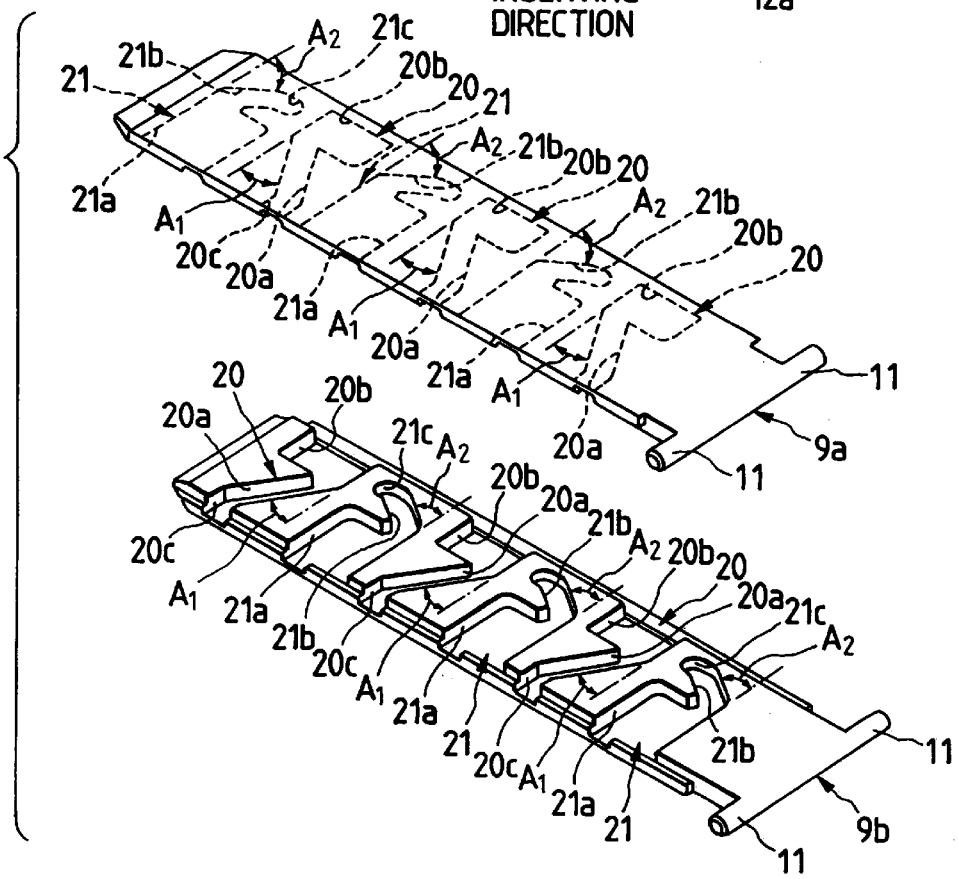
Figure 2:
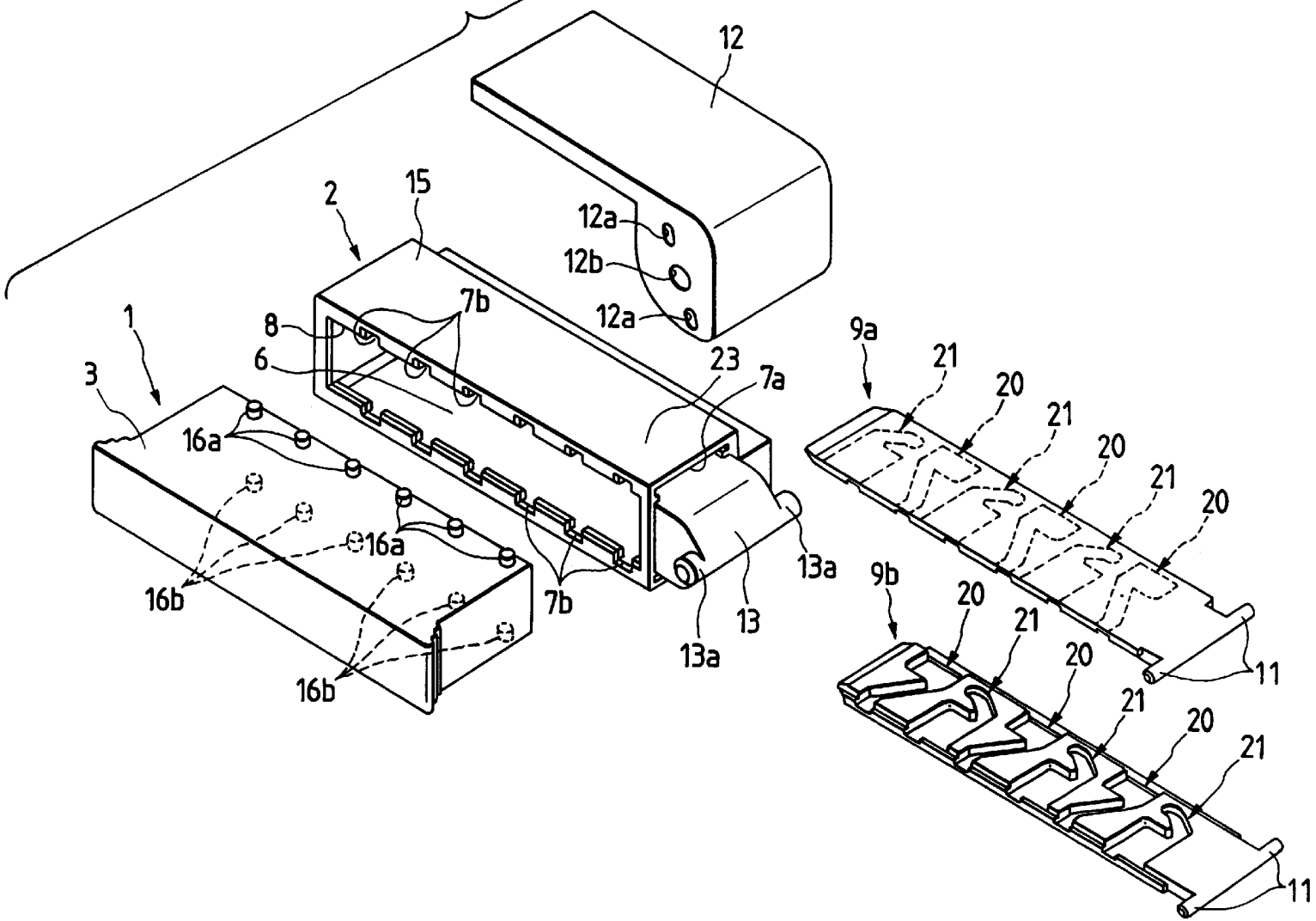
FIG. 2 is an exploded, perspective view of a female connector.

FIG. 1(*a*) is a perspective view of one preferred embodiment of a connector connecting structure of the present invention, FIG. 1(*b*) is a perspective view of a pair of moving members, and FIG. 2 is an exploded, perspective view of a female connector. In FIGS. 1(*a*), 1(*b*) and 2, the connector connecting structure comprises a male connector 1 and a female connector 2, and the male connector 1 can be inserted relative to the female connector 2 from an insertion start position through a provisionally-fitted position into a completely-fitted position. A connector receiving chamber 6 for receiving the male connector 1 is formed in a female housing 15 of the female connector 2, and one side of this connector receiving chamber 6 is open to form an insertion port 8.

Moving chambers 5 are formed in the female housing 15, and are defined respectively by spaces disposed respectively at opposite (upper and lower) sides of the connector receiving chamber 6, and the inner side of each of the moving chambers 5 is open to the connector receiving chamber 6. Six guide ports 7*b* for respectively receiving cam pins 16*a* or 16*b* are formed in each of opposite side (upper and lower) edge portions of the insertion port 8 in the female housing 15, and each of the guide ports 7*b* is open at its one side to the insertion port 8, and also is open to the corresponding moving chamber 5. Moving members 9*a* and 9*b* are provided in the pair of moving chambers 5, respectively, and the pair of moving members 9*a* and 9*b* can be moved independently of each other in directions perpendicular to a connector-inserting direction.

Each of the moving members 9*a* and 9*b* is rotatably supported at its one end on an operating member 12 pivotally supported on the female housing 15, and the construction of these moving members is similar to that described above for the conventional structure, and therefore corresponding portions will be designated by identical reference numerals, and detailed description thereof will be omitted. Therefore, when the operating member 12 is turned, the pair of moving members 9*a* and 9*b* are moved in opposite directions, respectively. The operating member 12 is turned or displaced between a preset position and a set position. The upper surface of the female housing 15 (serving as an operating-member mounting member) of the female connector 2 serves as an operating-member laying surface 23. In the preset position of the operating member 12, the operating member 12 is disposed in a generally upstanding condition, with its distal end portion spaced from the operating-member laying surface 23, and in the set position, the operating member 12 is disposed in a laid-flat condition, with its distal end portion held in contact with the operating-member laying surface 23.

Cam means K, which performs its function when inserting the male connector 1, is provided at the pair of moving members 9*a* and 9*b* and the male connector 1. The cam means K includes six cam grooves 20 and 21 formed in each of the pair of moving members 9*a* and 9*b*, and six cam pins 16*a* or 16*b* formed on each of the upper and lower surfaces of a male housing 3 of the male connector 1.

Two kinds of cam grooves 20 and 21 are used. More specifically, the cam groove 20 has an operation-purpose inclined groove portion 20*a*, which engages the cam pin 16*a* or 16*b* during the connector-inserting process from the insertion start position to the provisionally-fitted position, and a non-cam groove portion 20*b* which does not engage the cam pin 16*a* or 16*b* during the connector-inserting process from the provisionally-fitted position to the completely-fitted position. On the other hand, the cam groove 21 has a non-cam groove portion 21*a*, which does not engage the cam pin 16*a* or 16*b* during the connector-inserting process from the insertion start position to the provisionally-fitted position, and a fitting-purpose inclined groove portion 21*b* which engages the cam pin 16*a* or 16*b* during the connector-inserting process from the provisionally-fitted position to the completely-fitted position.

The two kinds of cam grooves 20 and 21 are alternately arranged in each of the moving members 9*a* and 9*b*, and the vertically-opposed cam grooves (upper and lower cam grooves) 20 and 21 (or 21 and 20) are different in kind from each other.

An operation-purpose inclination angle $A_1$ of the operation-purpose inclined groove portion 20*a* of the cam groove 20 is so determined that the direction of a component force of a pressing force, applied to the moving member 9*a* or 9*b* by the cam groove 20 and the cam pin 16*a* or 16*b*, is a direction toward the set position of the operating member 12, and that the operating member can be displaced to the set position in the provisionally-fitted condition. A fitting-purpose inclination angle $A_2$ of the fitting-purpose inclined groove portion 21*b* of the cam groove 21 is so determined that the direction of a component force of a pressing force, applied to the moving member 9*a* or 9*b* by the cam groove 21 and the cam pin 16*a* or 16*b*, is a direction toward the set position of the operating member 12, and that the operating member can be displaced to the set position in the completely-fitted position. The pair of moving members 9*a* and 9*b* are moved in the opposite directions, respectively, and therefore the directions of the inclination angles of the cam grooves 20 and 21 in the upper moving member 9*a* are reverse to the directions of the inclination angles of the cam grooves 20 and 21 in the lower moving member 9*b* relative to the connector-inserting direction.

The cam groove 20 has a pin-introducing portion 20*c* provided at the pin-inserting side of the operation-purpose inclined groove portion 20*a*, and this pin-introducing portion 20*c* extends in the connector-inserting direction. The cam groove 21 has a pin stroke end portion 21*c* provided at the inner end portion thereof, and this portion 21*c* extends in the direction of movement of the moving members 9*a* and 9*b*.

Figure 3A:
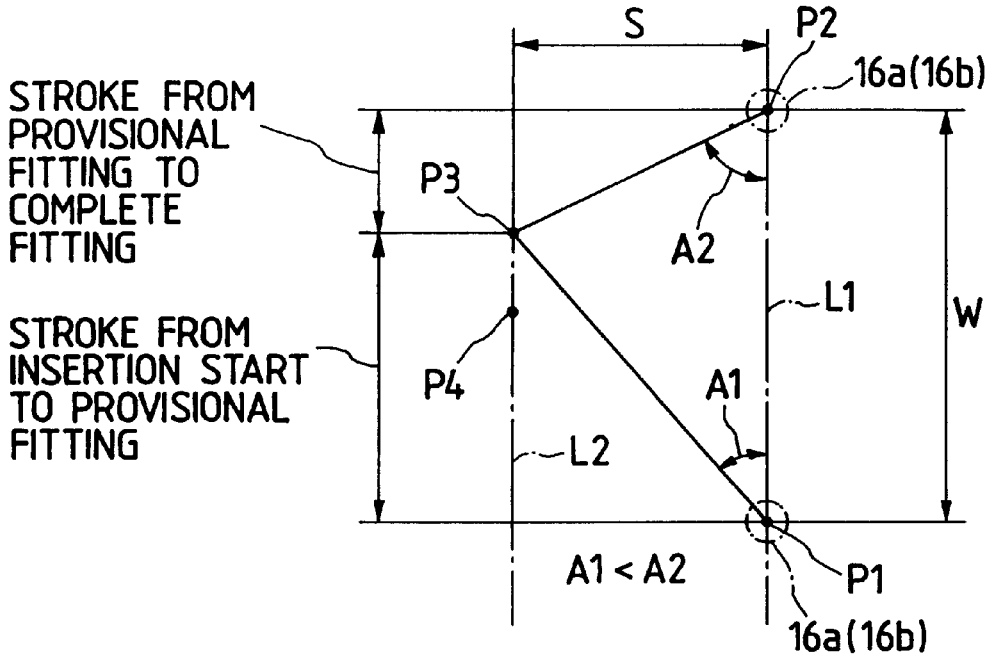
FIG. 3(*a*) is an illustration showing the setting relation between an operation-purpose inclination angle and a fitting-purpose inclination angle.
Figure 3B:
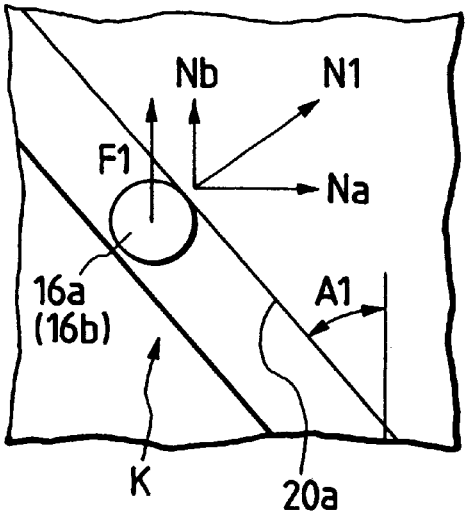
Figure 3C:
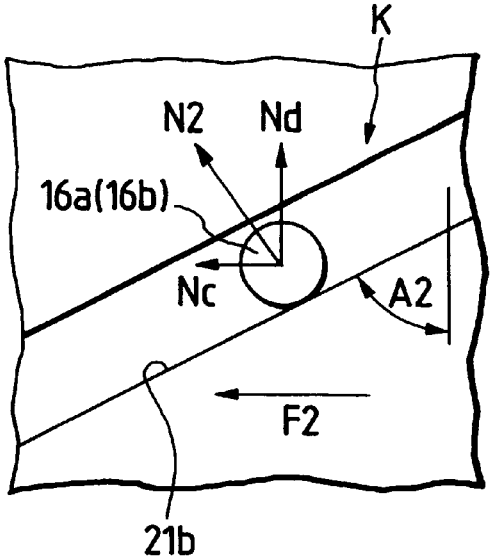

FIG. 3(*a*) is an illustration showing the setting relation between the operation-purpose inclination angle $A_1$ and the fitting-purpose inclination angle $A_2$. In FIG. 3(*a*), W represents the width of the moving member 9*a* or 9*b*, and S represents a movement stroke of the moving member 9*a* or 9*b*. A groove insertion start point P1 for the cam pin 16*a* or 16*b* and a groove fitting completion point P2 are disposed on a common line L1, and a cross point P3 for the operation-purpose inclination angle $A_1$ and the fitting-purpose inclination angle $A_2$ is disposed on a line L2 which is parallel to and spaced from the line L1 by a distance equal to the movement stroke S. The cross point P3 defines the provisionally-fitted position in the direction of the width of the moving member 9*a* or 9*b*. By arbitrarily moving this cross point P3 on the line L2, the operation-purpose inclination angle $A_1$ and the fitting-purpose inclination angle $A_2$ can be varied, and these angles are so determined or set that the fitting-purpose inclination angle $A_2$ is larger than the operation-purpose inclination angle $A_1$. Incidentally, if this cross point is disposed at a middle point P4 of the width of the moving member 9*a* or 9*b*, the operation-purpose inclination angle $A_1$ and the fitting-purpose inclination angle $A_2$ are equal to each other, and the stroke from the connector insertion start position to the provisionally-fitted position is equal to the stroke from the provisionally-fitted position to the completely-fitted position.

As in the conventional structure, press-connecting terminals which are female terminals (not shown) are mounted in the male connector 1, and pin terminals which are male terminals (not shown) are mounted in the female connector 2. During the connector insertion process from the insertion start position to the provisionally-fitted position, the male terminals will not come into contact with the female terminals, respectively.

Figure 8:
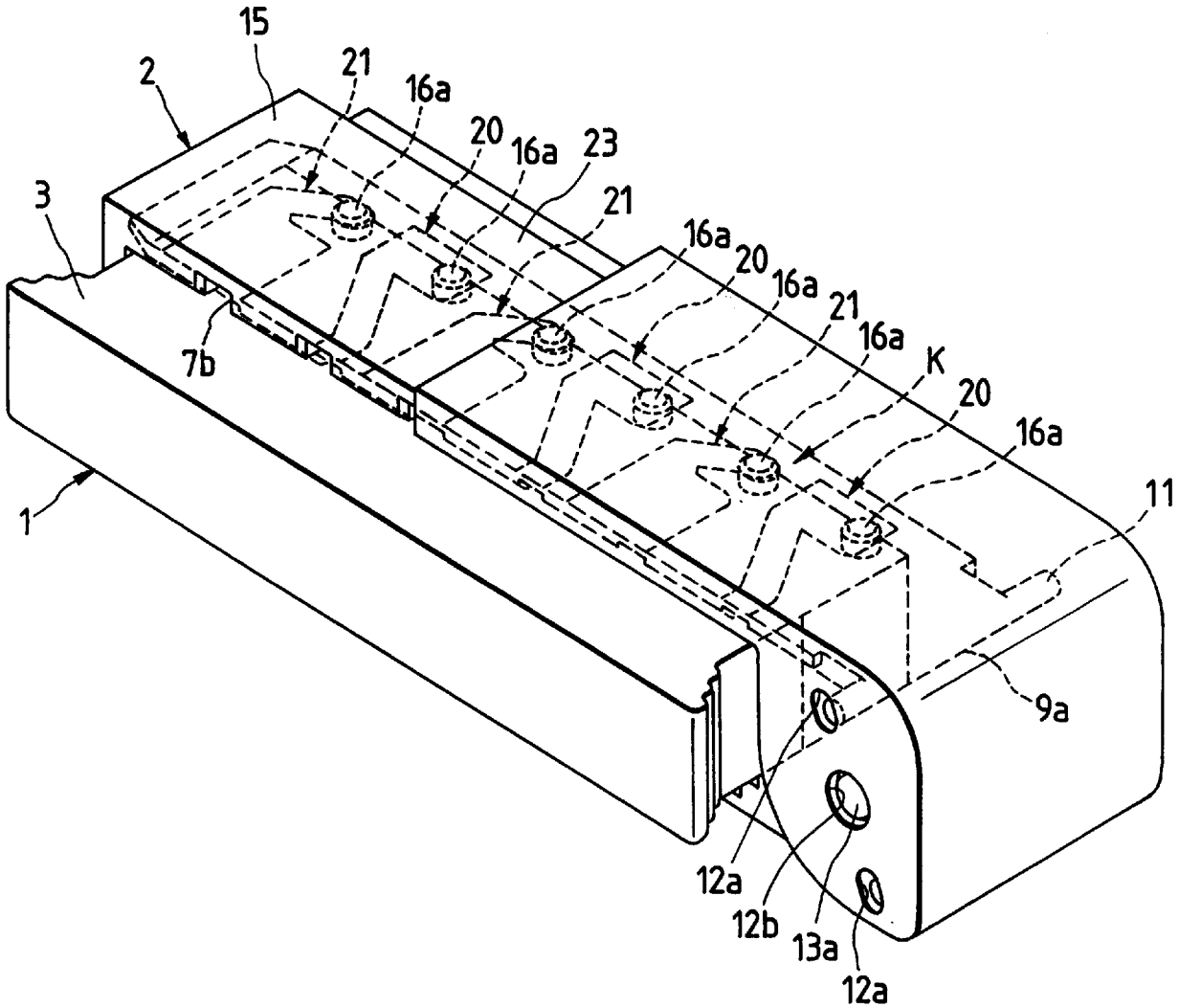
FIG. 8 is a perspective view of the connector connecting structure of the embodiment, with the male connector located in a fitted position.
Figure 9:
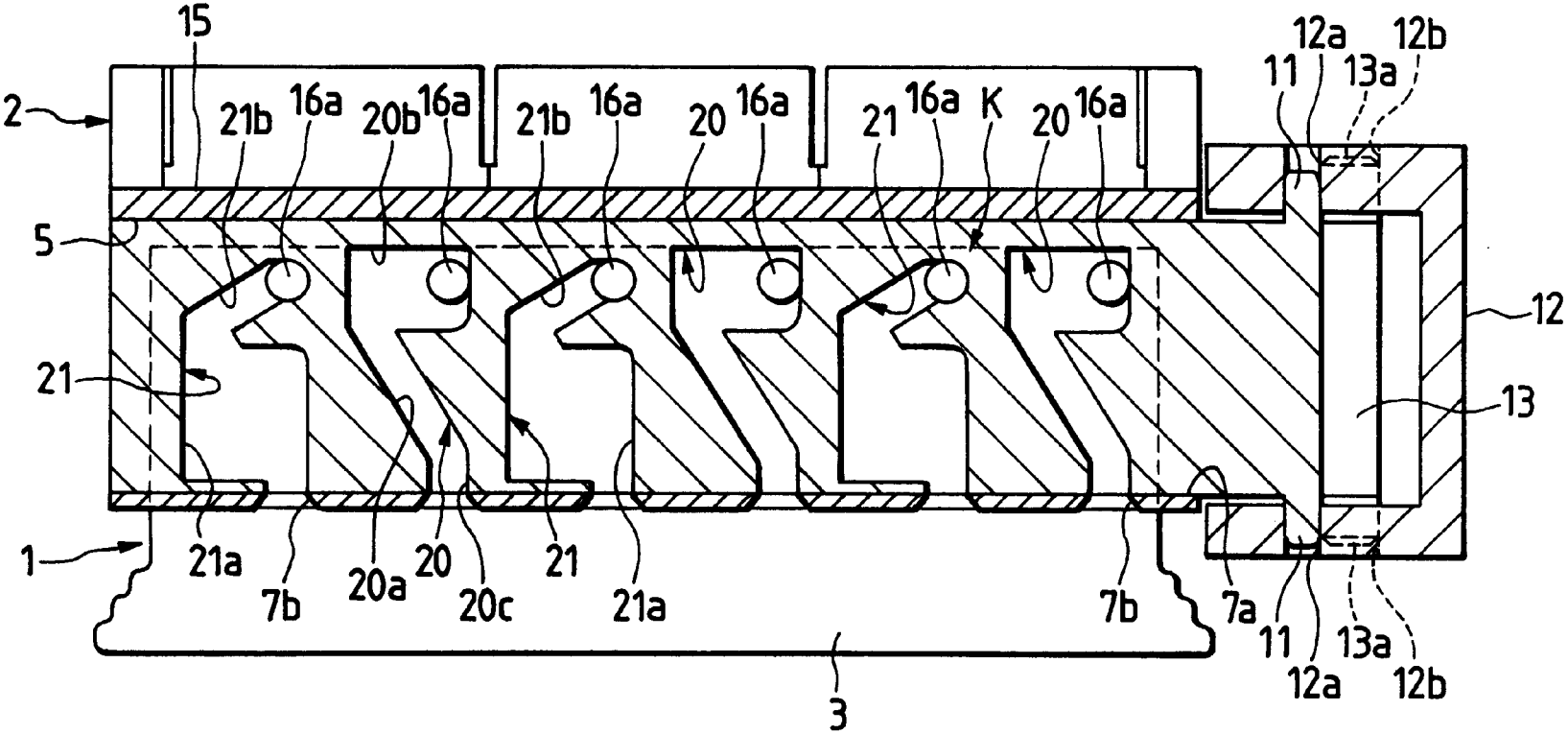
FIG. 9 is a cross-sectional view of the connector connecting structure of the embodiment, with the male connector located in the fitted position.
Figure 10:
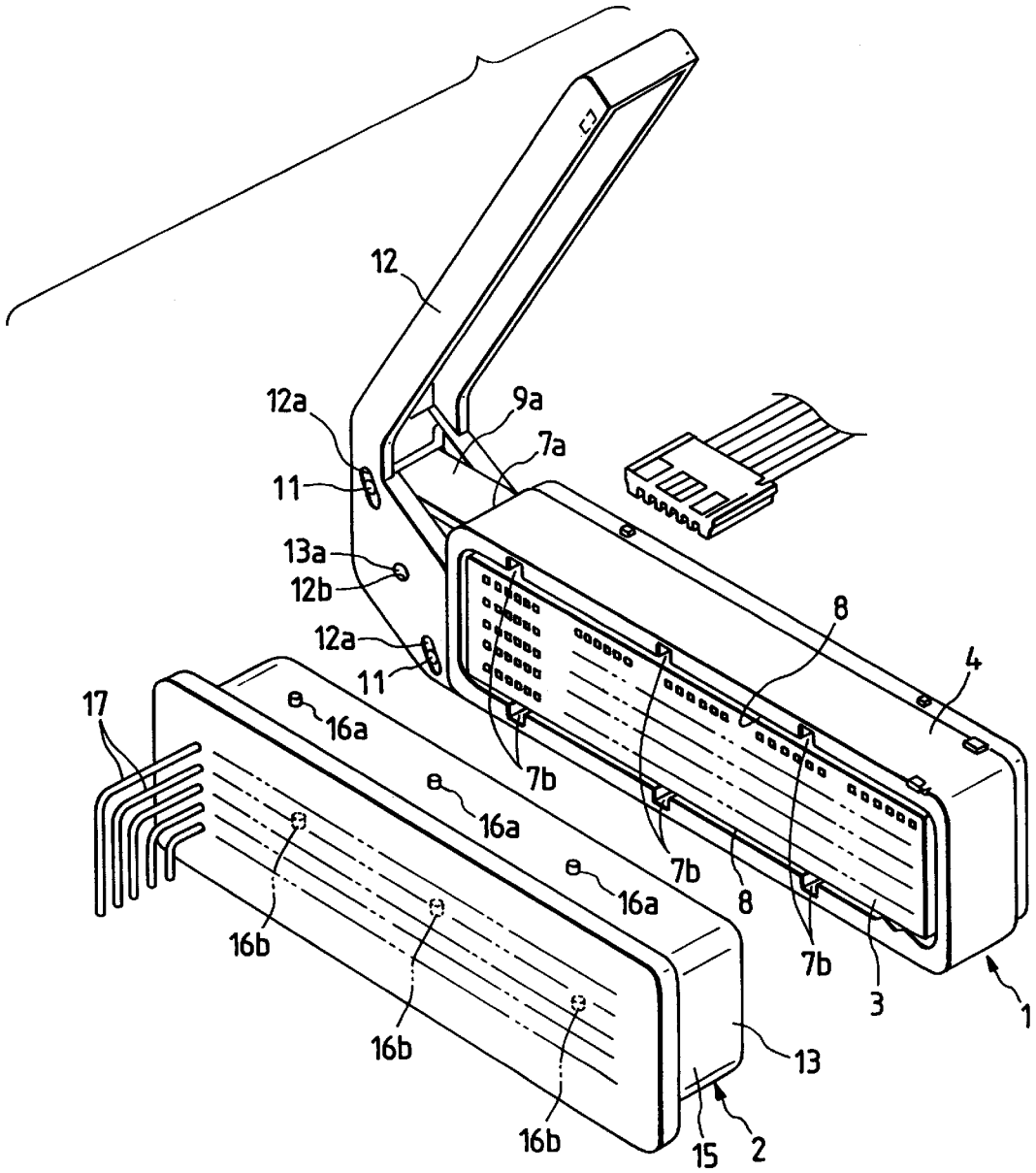
FIG. 10 PRIOR ART
FIG. 10 is a perspective view of a conventional connector connecting structure, showing a condition before male and female connectors are fitted together.
Figure 11:
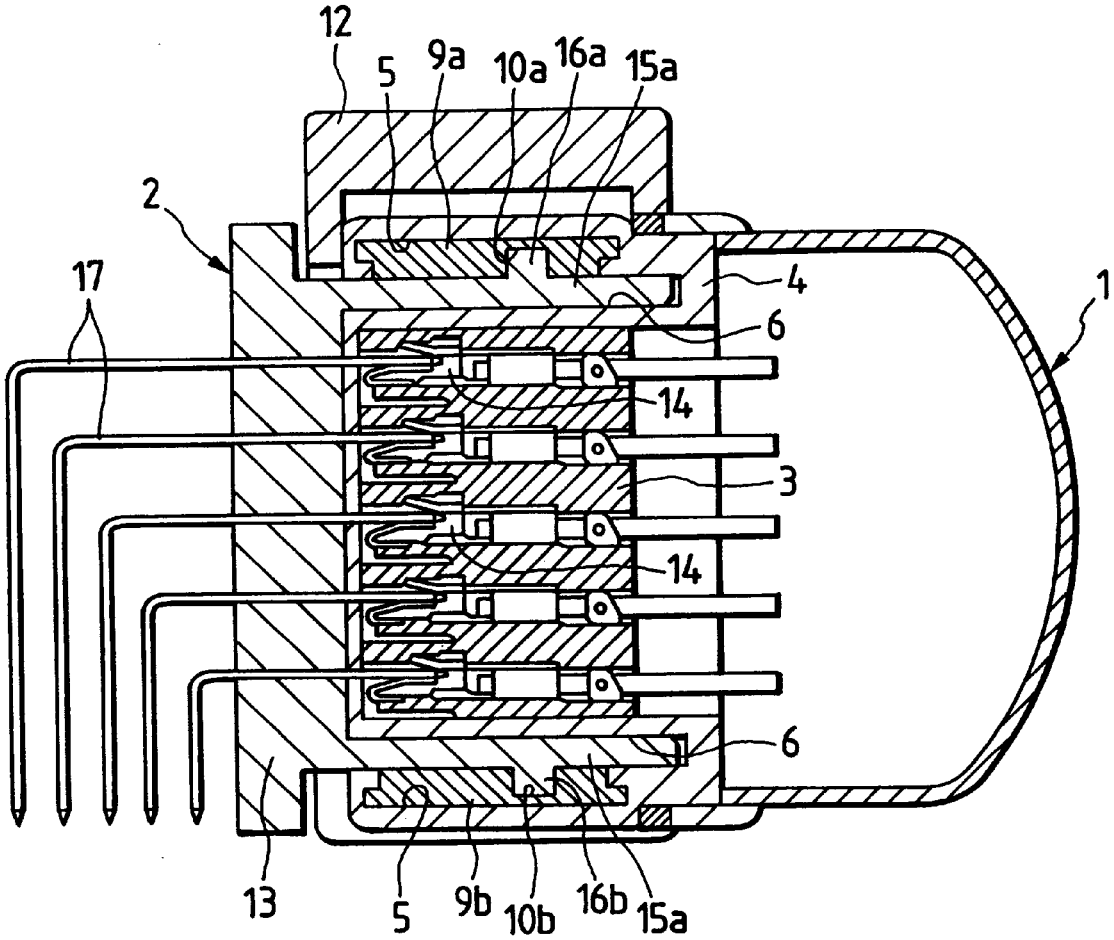
FIG. 11 PRIOR ART
FIG. 11 is a cross-sectional view of the conventional connector connecting structure in a fitted condition.
Figure 12:
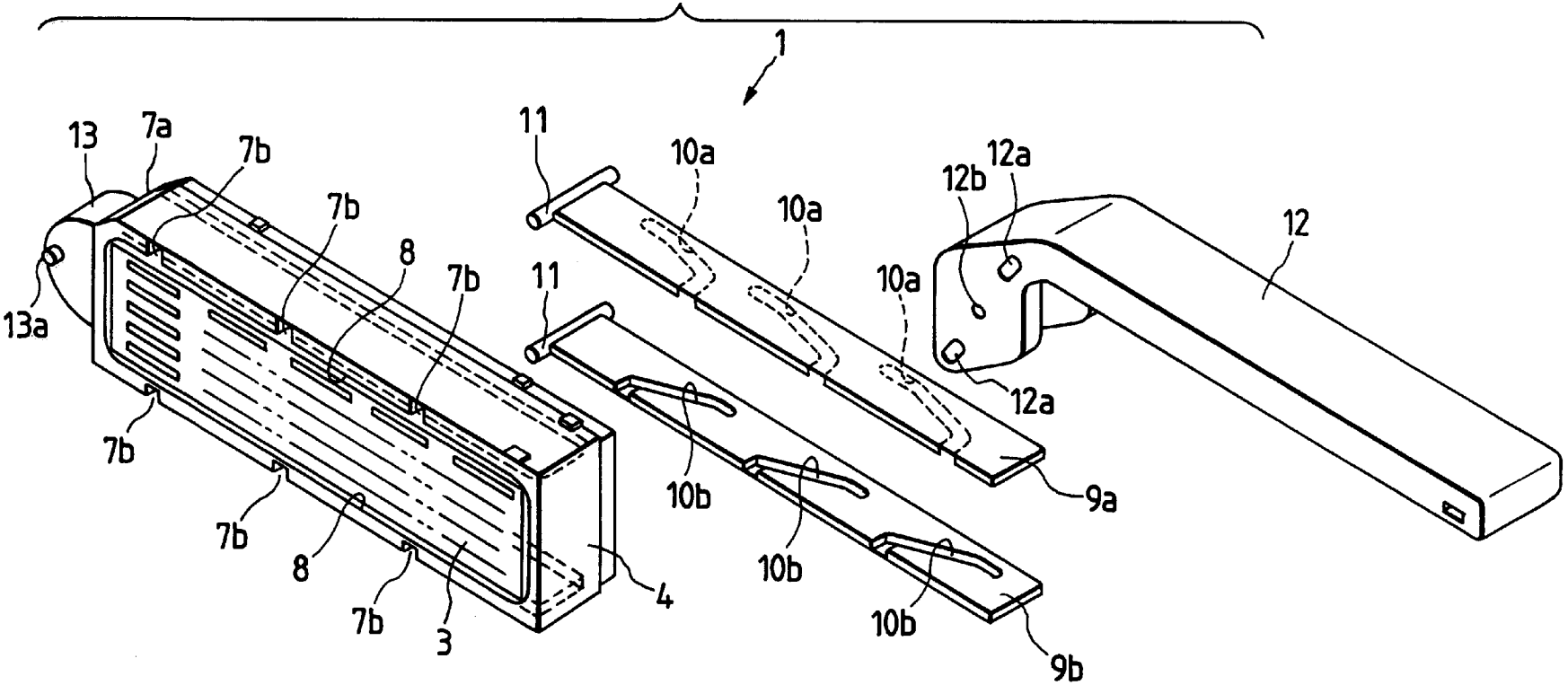
FIG. 12 PRIOR ART
FIG. 12 is an exploded, perspective view of the male connector of the conventional structure.
Figure 13A:
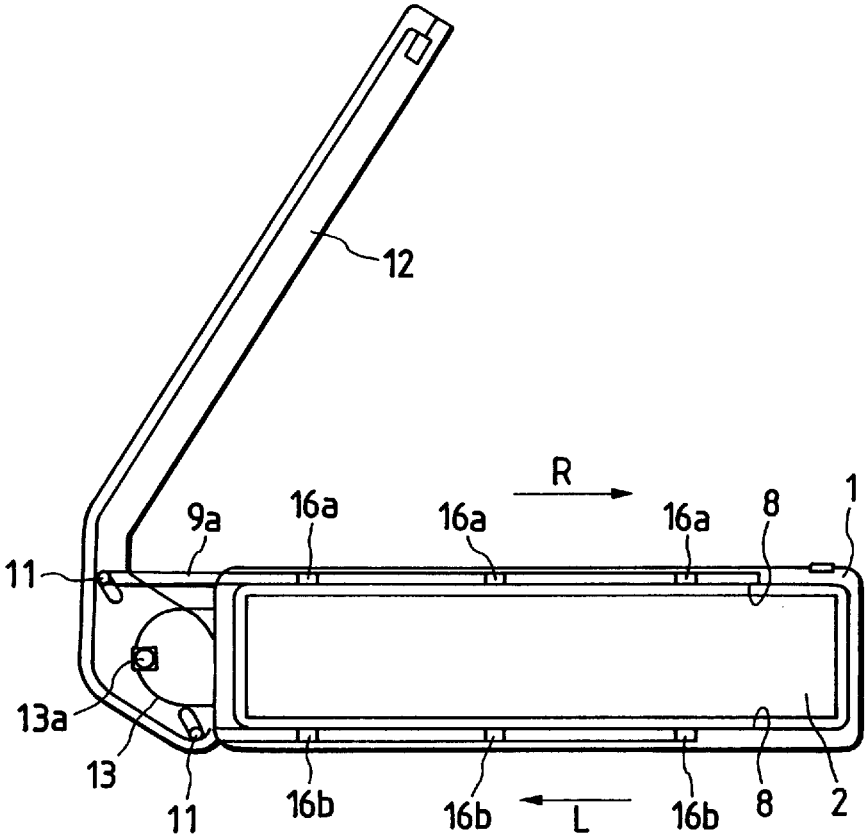
FIG. 13(a) PRIOR ART
FIGS. 13(*a*) and 13(*b*) are a perspective view and a cross-sectional view of the conventional structure, respectively, showing an initial stage of the fitting operation.
Figure 13B:
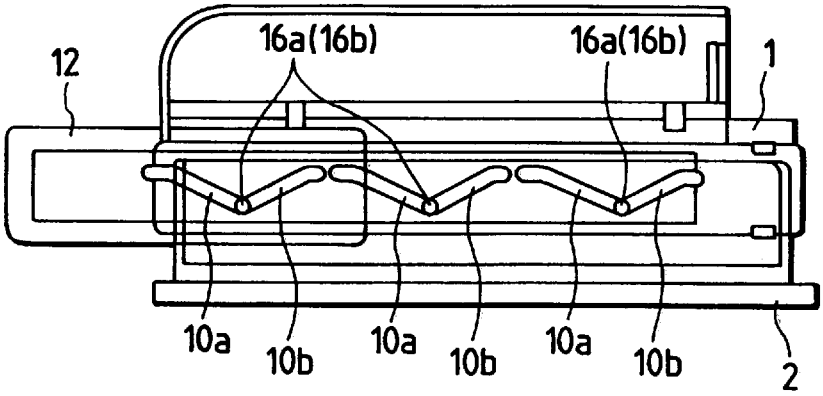
FIG. 13(b) PRIOR ART
Figure 14A:
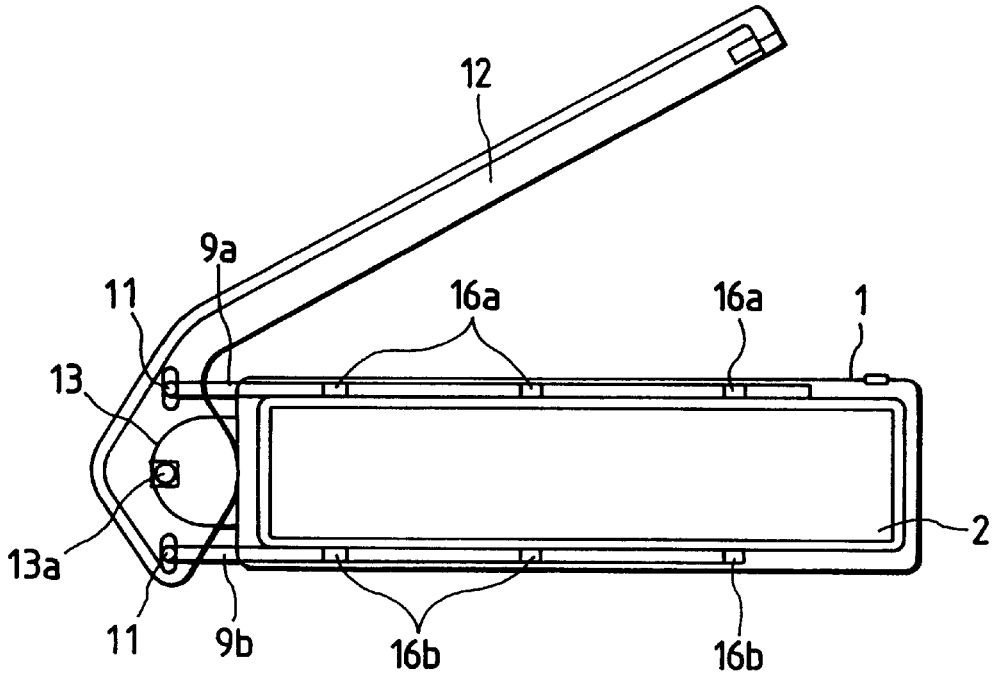
FIG. 14(a) PRIOR ART
FIGS. 14(*a*) and 14(*b*) are a perspective view and a cross-sectional view of the conventional structure, respectively, showing an intermediate stage of the fitting operation.
Figure 14B:
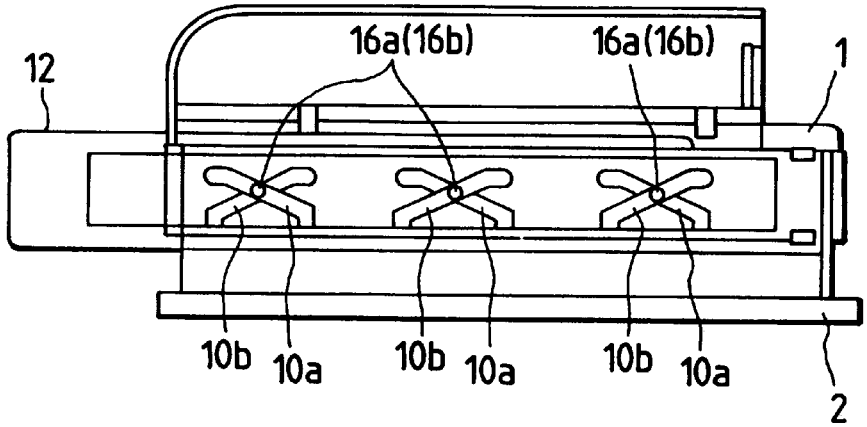
FIG. 14(b) PRIOR ART
Figure 15A:
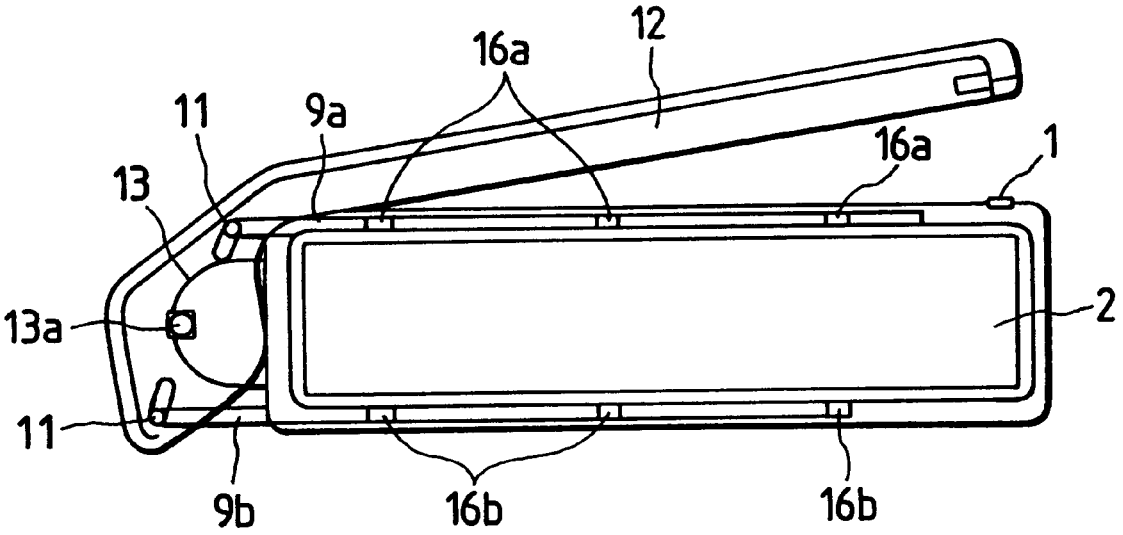
FIG. 15(a) PRIOR ART
FIGS. 15(*a*) and 15(*b*) are a perspective view and a cross-sectional view of the conventional structure, respectively, showing an intermediate stage of the fitting operation.
Figure 15B:
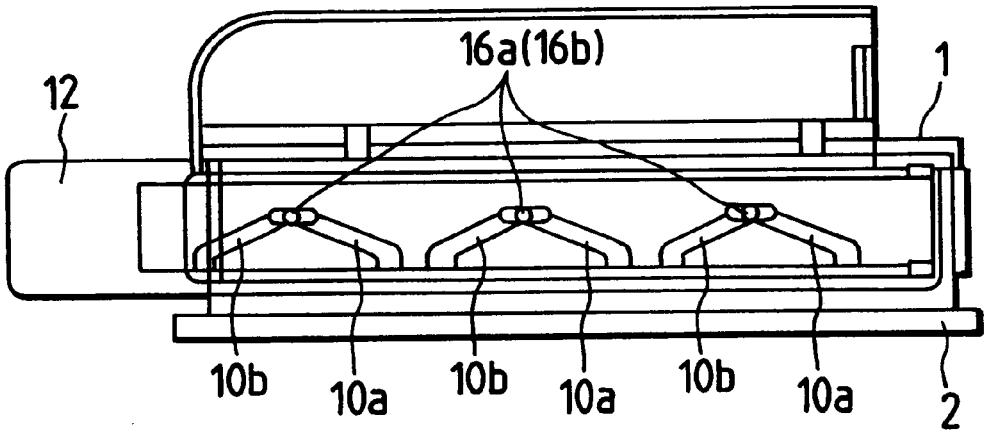
FIG. 15(b) PRIOR ART
Figure 16A:
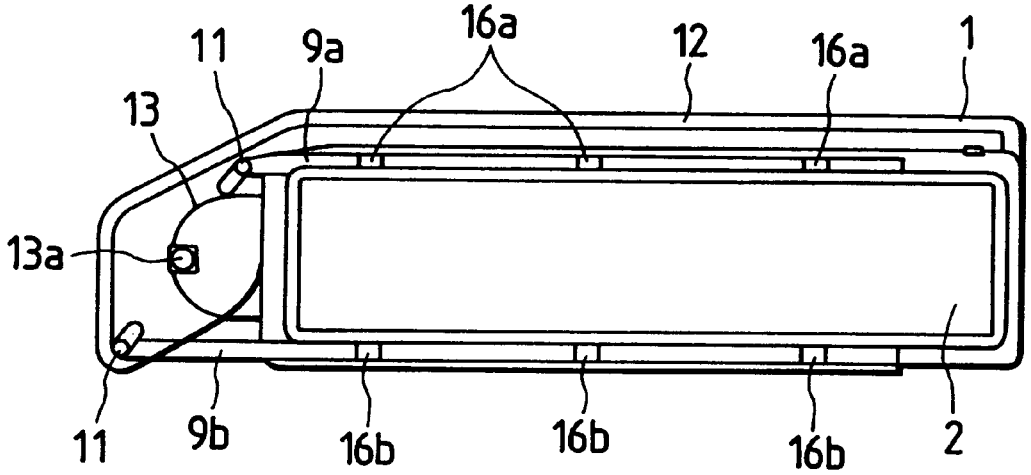
FIG. 16(a) PRIOR ART
FIGS. 16(*a*) and 16(*b*) are a perspective view and a cross-sectional view of the conventional structure, respectively, showing a final stage of the fitting operation.
Figure 16B:
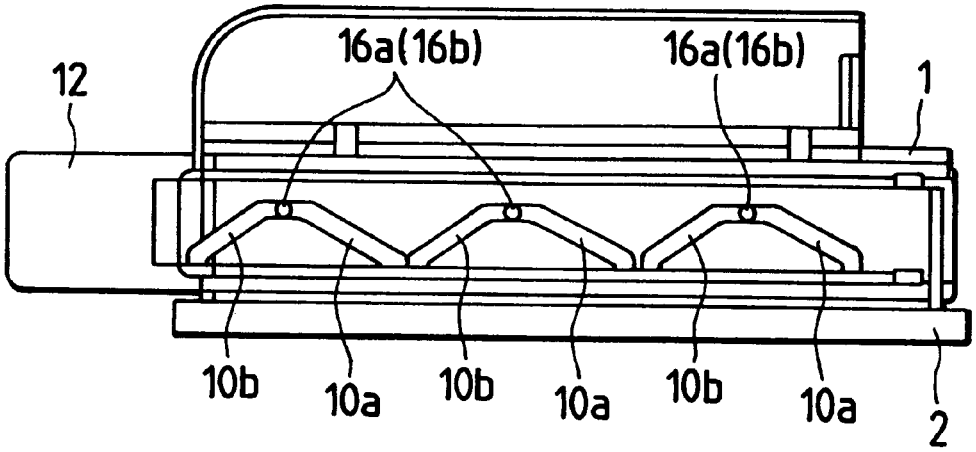
FIG. 16(b) PRIOR ART

Next, the fitting operation of the above connector connecting structure will be described with reference to FIGS. 4 to 9. FIGS. 5, 7 and 9 show the positional relation between the cam grooves 20 and 21 in the upper moving member 9*a* and the cam pins 16*a*.

Figure 4:
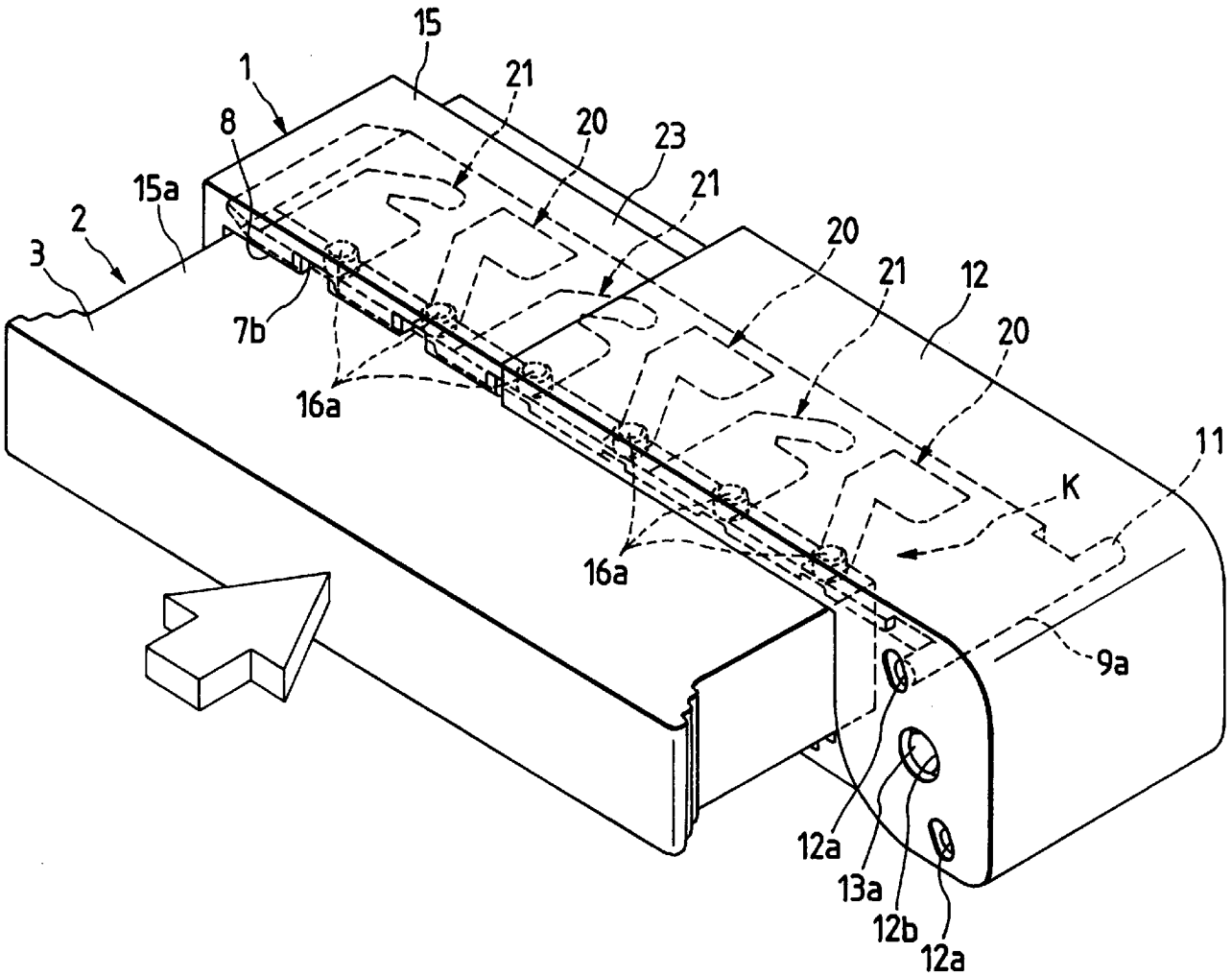
FIG. 4 is a perspective view of the connector connecting structure of the embodiment, with a male connector located in a insertion start position.
Figure 5:
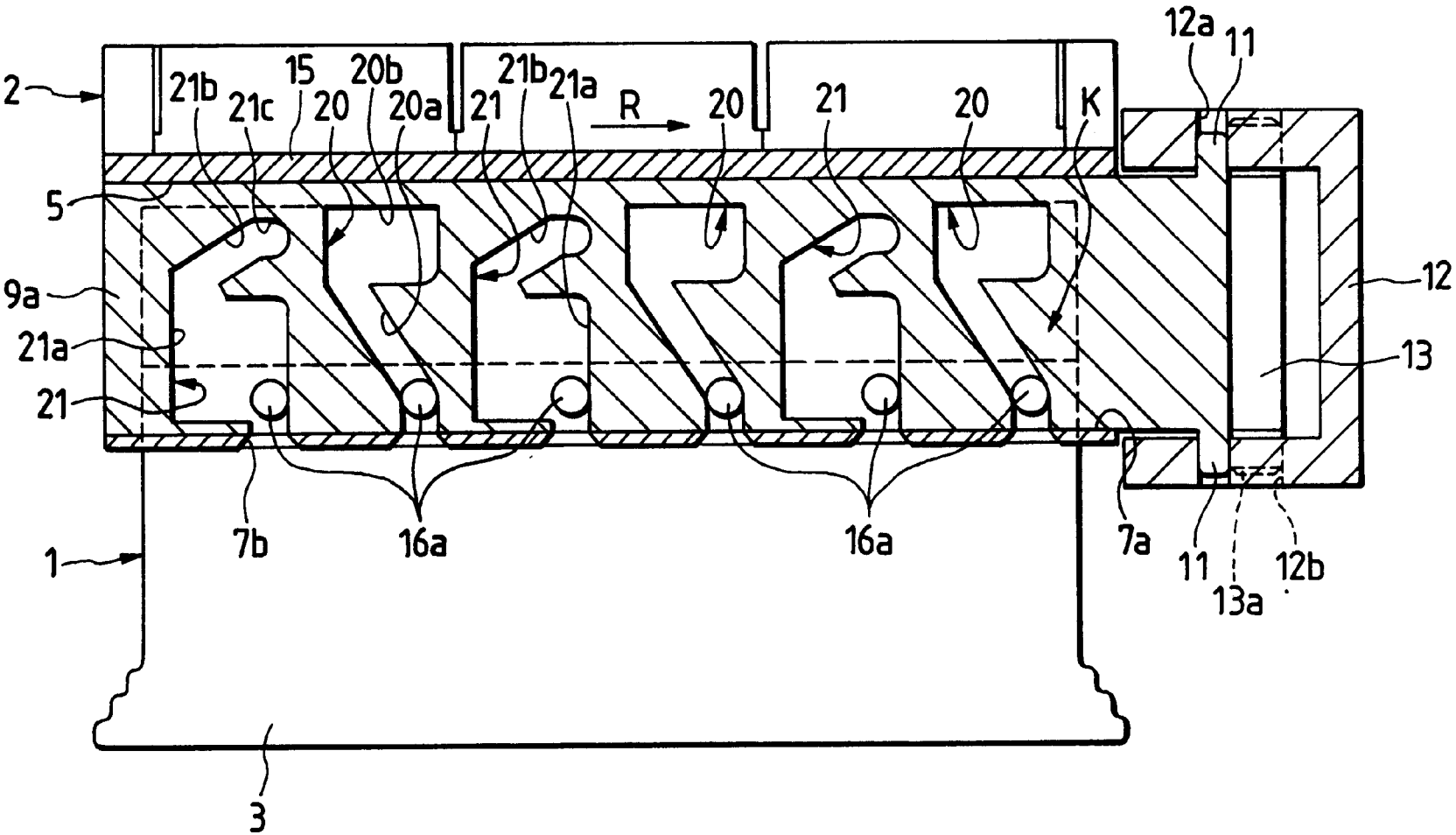
FIG. 5 is a cross-sectional view of the connector connecting structure of the embodiment, with the male connector located in the insertion start position.

As shown in FIG. 4, the operating member 12 is located in the set position where its distal end portion is held in contact with the operating-member laying surface 23 which is the upper surface of the female housing 15. In this condition, when the male housing 3 of the male connector 1 is inserted into the connector receiving chamber 6 in the female housing 15 of the female connector 2 through the insertion port 8, the cam pins 16*a* or 16*b* are introduced respectively into the associated cam grooves 20 and 21 in the moving member 9*a* or 9*b* through the respective openings 7*b*, as shown in FIGS. 4 and 5. When the male housing 3 of the male connector 1 is further inserted from the position of FIGS. 4 and 5, the upper moving member 9*a* is pressed or urged by the cam pins 16*a* to be moved in a right-hand direction (as indicated by arrow R) while the lower moving member 9*b* is pressed or urged by the cam pins 16*b* to be moved in an opposite (left-hand) direction.

Figure 6:
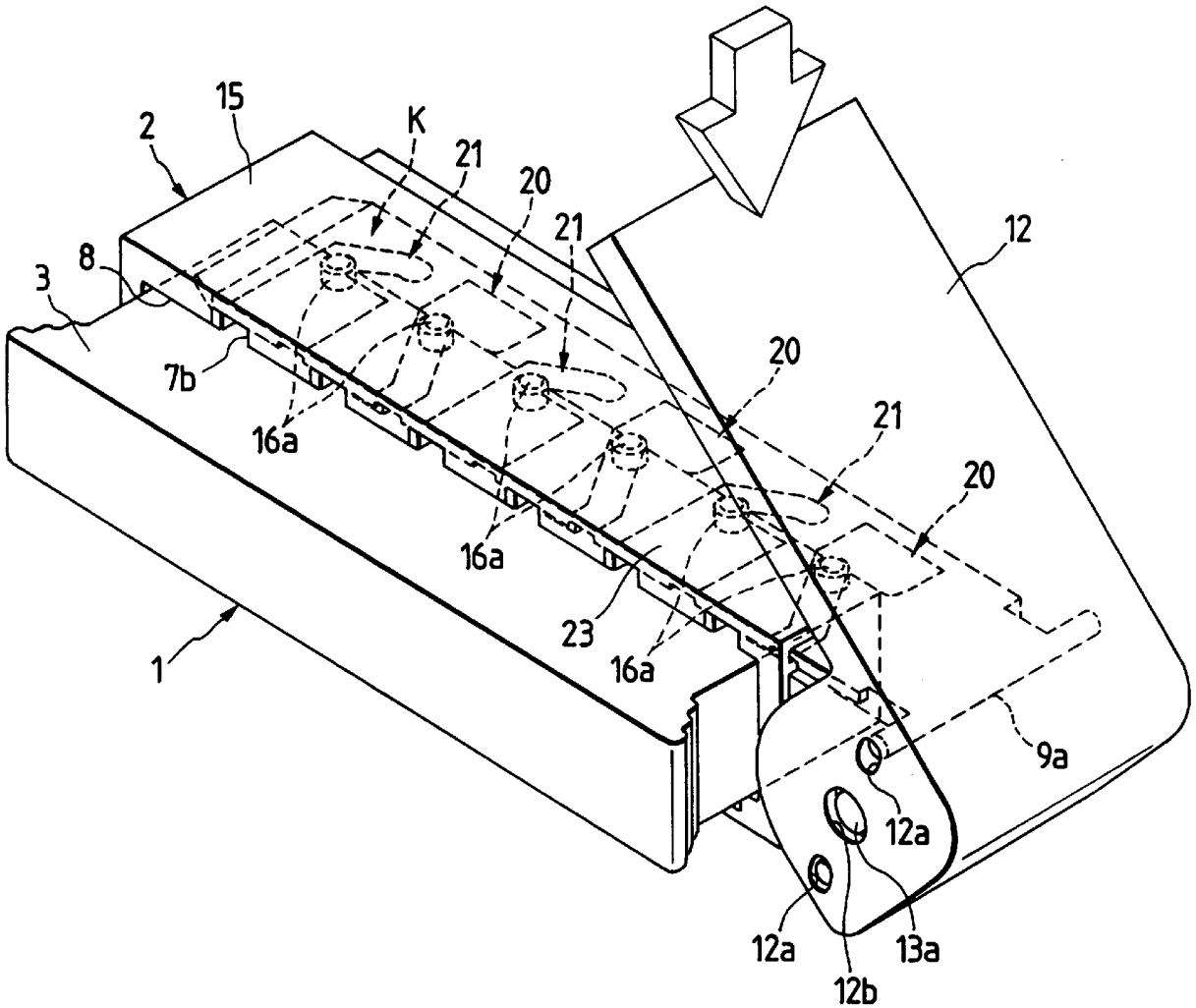
FIG. 6 is a perspective view of the connector connecting structure of the embodiment, with the male connector located in a provisionally-fitted position.
Figure 7:
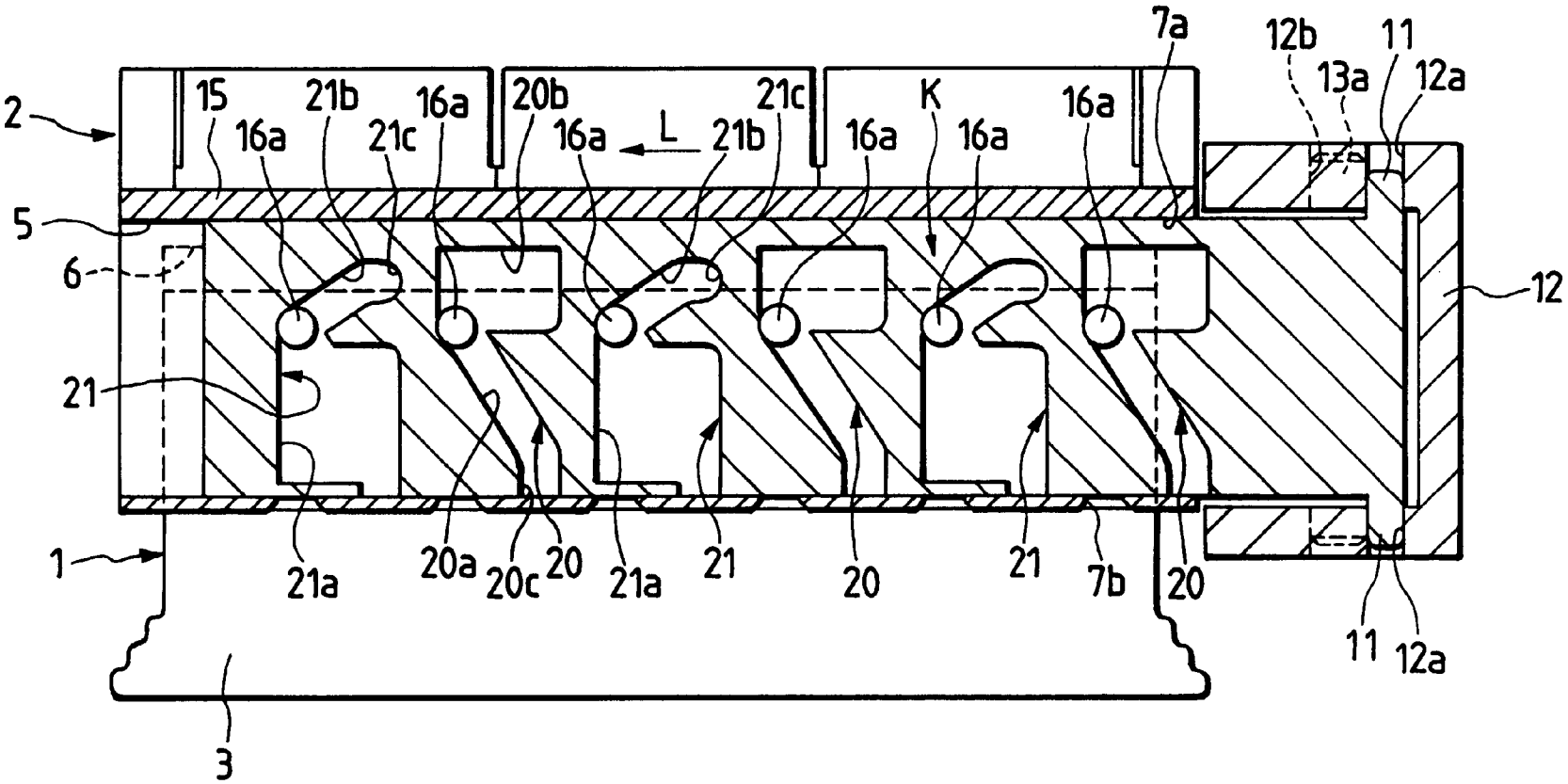
FIG. 7 is a cross-sectional view of the connector connecting structure of the embodiment, with the male connector located in the provisionally-fitted position.

In accordance with each of the above movements, the operating member 12 is turned from the set position toward the preset position, and when the connector is inserted into the provisionally-fitted position as shown in FIGS. 6 and 7, the operating member 12 is brought into the preset position where its distal end portion is sufficiently spaced from the operating-member laying surface 23. In the provisionally-fitted position, each cam pin 16*a* is located at the terminating end of the associated operation-purpose inclined groove portion 20*a* or the starting end of the associated fitting-purpose inclined groove portion 21*b*.

When the operating member 12 is turned toward the set position from the position of FIGS. 6 and 7 as indicated by an arrow in FIG. 6, the pair of moving members 9*a* and 9*b* are moved respectively in the opposite directions, that is, the upper moving member 9*a* is moved left (as indicated by arrow L) while the lower moving member 9*b* is moved right. As a result, those cam pins 16*a*, received respectively in the cam grooves 21, are pressed respectively by the fitting-purpose inclined groove portions 21*b*, and the male connector 1 is drawn into the female connector 2 by component force of these pressing forces. Then, when the operating member 12 is again turned into the set position, each cam pin 16*a* is located at the terminating end of the associated fitting-purpose inclined groove portion 21*b* or the terminating end of the associated non-cam groove portion 20*b*, as shown in FIGS. 8 and 9, thus finishing the fitting operation of the connector connecting structure.

For effecting the disconnecting operation of the connector connecting structure, the operating member 12 is turned in the direction reverse to the above-described direction, that is, from the preset position into the set position, so that the male connector 1 is displaced to the provisionally-fitted position. Then, the male connector 1 is withdrawn from the female connector 2 from the provisionally-fitted position to the insertion start position, so that the operating member 12 is returned to the set position, thus finishing the disconnecting operation.

In the above connector fitting operation, when the connector begins to be inserted with the operating member 12 located in the set position, the operating member 12 is automatically brought into the preset position, and therefore the operating member 12 need only to be manipulated by one motion from the preset position to the set position, and the fitting operation is easy. Similarly, the disconnecting operation of the connector connecting structure is also easy. Besides, the rotational position of the operating member 12 at the time of start of the fitting operation is the same as that at the time of finish of the fitting operation, and therefore the connector connecting structure can be easily handled.

Only when effecting the connector fitting operation and the disconnecting operation, the operating member 12 is brought into the preset position where its distal end portion is spaced from the operating-member laying surface 23 of the female connector 2, and except these occasions, the operating member 12 is located at the set position where its distal end portion is held in contact with the operating-member laying surface 23. Therefore, the possibility of damage due to contact with other part is reduced.

In the connector fitting operation, the moving members 9*a* and 9*b* are disposed respectively on the upper and lower sides of the male connector 1, and the pair of moving members 9*a* and 9*b* are moved in the opposite directions, respectively, and the directions of the inclination angles of the cam grooves 20 and 21 in the upper moving member 9*a* are reverse to those in the lower moving member 9*b*. Therefore, the pressing force, applied to the moving members 9*a* and 9*b* to displace the operating member 12 from the set position to the preset position, as well as the pressing force applied to the connector to insert the male connector 1 relative to the female connector 2 from the provisionally-fitted position to the completely-fitted position, acts symmetrically right and left. Therefore, the rotational forces of the same magnitude are exerted respectively at those positions which are symmetrical (that is, spaced 180 degrees from each other) with respect to the axis of rotation (pivotal movement) of the operating member 12, and therefore the operating member 12 can be smoothly turned, and besides the connector fitting force is exerted substantially uniformly over the entire length of the connector, so that the fitting operation can be effected smoothly.

In the connector fitting and disconnecting operations, the cam pins 16*a* and 16*b* are fitted in and guided respectively by the cam grooves 20 and 21, and therefore the movement of the cam pins 16*a* and 16*b* can be effected positively.

In the connector fitting operation, during the connector-inserting process from the insertion start position to the provisionally-fitted position, the male terminals will not be brought into contact with the female connectors, respectively, and therefore the connector can be inserted with a small insertion force applied to the rear surface of the connector, and the male terminals are contacted respectively with the female terminals during the insertion of the male connector from the provisionally-fitted position to the completely-fitted position when the large insertion force is obtained by the cam means K. Therefore, the fitting operation can be effected with a relatively small operating force as a whole, and the fitting operation can be effected smoothly and easily.

The pressing force, acting between the cam pin 16*a* or 16*b* and the moving member 9*a* or 9*b* in the connector fitting operation, is as follows. FIG. 3(*b*) is an illustration showing the force acting between the cam groove 20 and the cam pin 16*a* or 16*b*, and FIG. 3(*c*) is an illustration showing the force acting between the cam groove 21 and the cam pin 16*a* or 16*b*. In FIG. 3(*b*), during the connector-inserting process from the insertion start position to the provisionally-fitted position, the cam pin 16*a* or 16*b* presses the moving member 9*a* or 9*b* through the operation-purpose inclined groove portion 20*a* with an insertion force F1. As a result, a pressing force N1 perpendicular to the inclination angle acts on the moving member 9*a* or 9*b*, and the moving member 9*a* or 9*b* is moved by a component force Na of this pressing force N1 (In this case, the direction of movement of the upper moving member 9*a* is opposite to that of the lower moving member 9*b*). The operation-purpose inclination angle $A_1$ is smaller than the fitting-purpose inclination angle $A_2$, and therefore, generally, this component force Na is larger than the other component force Nb, so that the large moving force can be obtained.

In FIG. 3(*c*), during the turning of the operating member 12 from the preset position to the set position, the moving member 9*a* or 9*b* presses the cam pin 16*a* or 16*b* through the fitting-purpose inclined groove portion 21*b* with a pressing force F2. As a result, a pressing force N2 perpendicular to the inclination angle acts on the cam pin 16*a* or 16*b*, and the male connector 1 is inserted by a component force Nd of this pressing force N2. The fitting-purpose inclination angle $A_2$ is larger than the operation-purpose inclination angle $A_1$, and therefore this component force Nd is larger than the other component force Nc, so that the large insertion force can be obtained.

In the above embodiment, the two kinds of cam grooves 20 and 21 are provided in each moving member, and the cam groove 20 engages the cam pin 16*a* or 16*b* only at the operation-purpose inclined groove portion 20*a* having the operation-purpose inclination angle, and the cam groove 21 engages the cam pin 16*a* or 16*b* only at the fitting-purpose inclined groove portion 21*b* having the fitting-purpose inclination angle. The cam pins 16*a* or 16*b* are classified into those each receiving the reaction force (external force) through the associated operation-purpose inclined groove portion 20*a*, and those each receiving the pressing force (external force) through the associated fitting-purpose inclined groove portion 21*b*, and therefore the durability of the cam pins 16*a* and 16*b* are enhanced.

In the above embodiment, although the moving members 9*a* and 9*b* are mounted on the female connector 2, these moving members may be mounted on the male connector 1. Although the cam grooves 20 and 21 are formed in the moving members 9*a* and 9*b* while the cam pins 16*a* and 16*b* are formed on the male connector 1, the cam grooves 20 and 21 may be formed in the male connector 1 or the female connector 2, in which case the cam pins 16*a* are formed on the moving members 9*a* while the cam pins 16*b* are formed on the moving member 9*b*.

In the above embodiment, the two kinds of cam grooves 20 and 21 are used. The cam groove 20 has the operation-purpose inclined groove portion 20*a*, which engages the cam pin 16*a* or 16*b* during the connector-inserting process from the insertion start position to the provisionally-fitted position, and the non-cam groove portion 20*b* which does not engage the cam pin 16*a* or 16*b* during the connector-inserting process from the provisionally-fitted position to the completely-fitted position. On the other hand, the cam groove 21 has the non-cam groove portion 21*a*, which does not engage the cam pin 16*a* or 16*b* during the connector-inserting process from the insertion start position to the provisionally-fitted position, and the fitting-purpose inclined groove portion 21*b* which engages the cam pin 16*a* or 16*b* during the connector-inserting process from the provisionally-fitted position to the completely-fitted position. However, one kind of cam grooves may be used. In this case, each cam groove has the operation-purpose inclined groove portion 20*a*, which engages the cam pin 16*a* or 16*b* during the connector-inserting process from the insertion start position to the provisionally-fitted position, and the fitting-purpose inclined groove portion 21*b* which engages the cam pin 16*a* or 16*b* during the connector-inserting process from the provisionally-fitted position to the completely-fitted position. With respect to the construction of the cam grooves 20 and 21, the cam groove and the inclination angle are suitably determined in accordance with the kind of the connector, the number of poles, and the size, and by doing so, the connector can be formed into a low insertion force connector.

In the above embodiment, although there are provided the pair of upper and lower moving members 9*a* and 9*b*, there may be used only one moving member.

As described above, in the invention, there is provided the connector connecting structure in which the male connector can be inserted relative to the female connector from the insertion start position through the provisionally-fitted position into the completely-fitted position, and the moving member, which is movable in the direction different from the connector-inserting direction, is mounted on one of the male and female connectors, and the operating member, which can be displaced between the preset position and the set position in accordance with the movement of the moving member, is mounted on the one connector, and the cam means is provided at the moving member and the other connector, and during the connector-inserting process from the insertion start position to the provisionally-fitted position, the cam means moves the moving member so as to displace the operating member from the set position to the preset position, and during the connector-inserting process from the provisionally-fitted position to the completely-fitted position, the operating member is manipulated to be moved from the preset position to the set position so as to move the moving member through the cam means, thereby displacing the other connector from the provisionally-fitted position to the completely-fitted position. Therefore, when the connector begins to be inserted with the operating member located in the set position, the operating member is automatically brought into the preset position, and therefore the manipulation of the operating member can be effected only by one motion from the preset position to the set position, and also the manipulation of the operating member for effecting the disconnecting operation can be effected only by one motion from the set position to the preset position, and therefore the fitting operation and disconnecting operation of the connector are easy.

What is claimed is:

1. A connector connecting structure comprising:

a male connector;

a female connector, wherein said male connector is operably inserted into said female connector from an insertion start position, through a provisionally-fitted position, and into a completely-fitted position;

at least one moving member which is movable in a direction different from a connector-inserting direction and mounted on one of said male and female connectors;

an operating member which is mounted on said one connector and displaced between a preset position and a set position in accordance with the movement of said at least one moving member; and a cam unit which is provided to engage said at least one moving member and the other of said male and female connectors, said cam unit comprising at least one cam groove and at least one cam pin, said at least one cam groove having a first portion which engages said cam pin and a second portion which does not engage said cam pin during a connector-inserting process from the insertion start position to the provisionally-fitted position, wherein said cam unit moves said at least one moving member so as to displace said operating member from the set position to the preset position, and during the connector-inserting process from the provisionally-fitted position to the completely-fitted position, said operating member being operable to move from the preset position to the set position so as to displace said at least one moving member using said cam unit, thereby displacing said other connector from the provisionally-fitted position to the completely-fitted position.

2. The connector connecting structure according to claim 1, wherein said at least one cam groove is formed in one of said at least one moving member and said other connector, and said at least one cam pin is formed on the other of said at least one moving member and said other connector, wherein said at least one cam pin is fitted into said at least one cam groove.

3. A connector connecting structure, comprising:

male and female connectors, said male connector being operably inserted into said female connector from an insertion start position through a provisionally-fitted position, and into a completely-fitted position;

a moving member which is movable in a direction different from a connector-inserting direction and mounted on one of said male and female connectors;

an operating member which is displaced between a preset position and a set position in accordance with the movement of said moving member and mounted on said one connector; and a cam unit which is provided to engage said moving member and the other of said male and female connectors, wherein during a connector-inserting process from the insertion start position to the provisionally-fitted position, said cam unit moves said moving member so as to displace said operating member from the set position to the preset position, and during the connector-inserting process from the provisionally-fitted position to the completely-fitted position, said operating member is manipulated to be moved from the preset position to the set position so as to move said moving member through said cam unit, thereby displacing said other connector from the provisionally-fitted position to the completely-fitted position, wherein said cam unit includes a cam groove which is formed in one of said moving member and said other connector, and a cam pin which is formed on the other of said moving member and said other connector and fitted into said cam groove, and wherein said cam groove includes an operation-purpose inclined groove portion for moving said moving member so as to displace said operating member from the set position to the preset position, and a fitting-purpose inclined groove portion for displacing said other connector from the provisionally-fitted position to the completely-fitted position by the movement of said moving member, and wherein a fitting-purpose inclination angle of said fitting-purpose inclined groove portion is larger than an operation-purpose inclination angle of said operation-purpose inclined groove portion.

4. A connector connecting structure, comprising:

male and female connectors said male connector being operably inserted into said female connector from an insertion start position, through a provisionally-fitted position and into a completely-fitted position;

a moving member which is movable in a direction different from a connector-inserting direction and mounted on one of said male and female connectors;

an operating member which is displaced between a preset position and a set position in accordance with the movement of said moving member and mounted on said one connector; and a cam unit which is provided to engage said moving member and the other of said male and female connectors wherein during a connector-inserting process from the insertion start position to the provisionally-fitted position said cam unit moves said moving member so as to displace said operating member from the set position to the preset position, and during the connector-inserting process from the provisionally-fitted position to the completely-fitted position, said operating member is manipulated to be moved from the preset position to the set position so as to move said moving member through said cam unit, thereby displacing said other connector from the provisionally-fitted position to the completely-fitted position, wherein said cam unit includes a cam groove which is formed in one of said moving member and said other connector, and a cam pin which is formed on the other of said moving member and said other connector and fitted into said cam groove, and wherein there are provided a plurality of said cam grooves of two kinds, each of said cam grooves of one kind including an operation-purpose inclined groove portion having an operation-purpose inclination angle and a non-cam groove portion which has no fitting-purpose inclination angle and does not engage said cam pin, and each of said cam grooves of the other kind including a non-cam groove portion which has no operation-purpose inclination angle and does not engage said cam pin and a fitting-purpose inclined groove portion having a fitting-purpose inclination angle.

5. The connector connecting structure according to claim 1, wherein there are provided a pair of said moving members which are disposed respectively on opposite sides of said other connector, and a pair of moving members, interlocked to said operating member, are operably moveable in opposite directions, respectively.

6. The connector connecting structure according to claim 1, wherein during the connector-inserting process from the insertion start position to the provisionally-fitted position, terminals mounted in said one connector and terminals mounted in said other connector are set in a positional relationship in which the terminals of said one connector are not contacted respectively with the terminals of said other connector.

7. The connector connecting structure according to claim 1, wherein said operating member is turned to be operably displaced between the preset position where a distal end portion thereof is spaced from an operating-member laying surface of an operating-member mounting member and the set position where the distal end portion is held in contact with the operating-member laying surface of the operating-member mounting member.

8. The connector connecting structure according to claim 5, wherein said pair of moving members have said cam grooves thereon, wherein adjacent cam groves on each of said pair of moving members have different shapes and wherein vertically-opposed cam grooves have different shapes.

* * * * *